US010251502B2

(12) United States Patent
Waltz

(10) Patent No.: US 10,251,502 B2
(45) Date of Patent: Apr. 9, 2019

(54) ADJUSTABLE LIQUID CONTAINER HOLDER

(71) Applicant: Garrett Waltz, Snohomish, WA (US)

(72) Inventor: Garrett Waltz, Snohomish, WA (US)

( * ) Notice: Subject to any disclaimer, the term of this patent is extended or adjusted under 35 U.S.C. 154(b) by 0 days.

(21) Appl. No.: 15/202,881

(22) Filed: Jul. 6, 2016

(65) Prior Publication Data

US 2017/0073112 A1 Mar. 16, 2017

Related U.S. Application Data

(60) Provisional application No. 62/217,377, filed on Sep. 11, 2015.

(51) Int. Cl.

| | |
|---|---|
| ***B65D 25/22*** | (2006.01) |
| ***B65D 43/02*** | (2006.01) |
| ***B65D 47/06*** | (2006.01) |
| ***B65D 47/20*** | (2006.01) |
| ***A47G 23/02*** | (2006.01) |
| ***A45F 5/00*** | (2006.01) |
| ***A47G 19/22*** | (2006.01) |

(52) U.S. Cl.

CPC ..... *A47G 23/0241* (2013.01); *A45F 5/00* (2013.01); *A47G 19/2266* (2013.01); *A45F 2200/0583* (2013.01); *B65D 25/22* (2013.01); *B65D 43/0202* (2013.01); *B65D 47/06* (2013.01); *B65D 47/20* (2013.01)

(58) Field of Classification Search

CPC ... A47G 23/0241; A47G 19/2266; A45F 5/00; A45F 2200/0583; B65D 25/22; B65D 47/06; B65D 47/20; B65D 43/0202

See application file for complete search history.

(56) References Cited

U.S. PATENT DOCUMENTS

| | | | | |
|---|---|---|---|---|
| 2,789,744 | A | 4/1957 | Brooks | |
| 3,229,859 | A * | 1/1966 | Conroy | A47L 1/08 222/174 |
| 4,089,440 | A * | 5/1978 | Lee | B65D 83/202 222/174 |
| 4,708,273 | A | 11/1987 | Grant et al. | |
| 4,789,084 | A * | 12/1988 | Yoshitomi | B05B 15/064 222/174 |
| 4,972,964 | A | 11/1990 | Escalante et al. | |
| 5,096,095 | A * | 3/1992 | Burton | F25D 23/126 222/146.6 |
| 5,154,324 | A * | 10/1992 | Stratford | A45F 5/00 222/175 |
| 5,318,492 | A * | 6/1994 | Quinn | A63B 21/072 222/175 |

(Continued)

*Primary Examiner* — Frederick C Nicolas

(74) *Attorney, Agent, or Firm* — Derek Clements; Bold IP, PLLC

(57) ABSTRACT

An adjustable liquid container holder and method, whereby a set of components that may be used for holding various types and sizes of liquid containers with the ability to temporarily hang or mount the liquid container holder and still retrieve liquid through a hose. The liquid container holder may have frame parts that are height adjustable to snugly fit a liquid container regardless of its height. The spigot may be configured with a detachable retractable cord and reel so that the spigot may be automatically retracted in close proximity to the liquid container holder upon release of the spigot from a user's hand.

18 Claims, 6 Drawing Sheets

(56) References Cited

U.S. PATENT DOCUMENTS

| | | | | |
|---|---|---|---|---|
| 5,879,456 | A * | 3/1999 | Curran | B05B 9/0403 118/317 |
| 6,213,515 | B1 * | 4/2001 | La Terra | B64F 1/28 137/351 |
| 6,318,600 | B1 * | 11/2001 | Winnett | B65D 83/386 222/173 |
| 6,966,461 | B2 * | 11/2005 | Warner | B65D 83/203 222/174 |
| 7,121,495 | B2 * | 10/2006 | Caamano | B65H 75/4478 242/390.5 |
| 7,207,538 | B2 | 4/2007 | Kent-Fawkes | |
| 7,837,069 | B2 * | 11/2010 | Kroub | G01F 15/068 141/24 |
| 7,927,175 | B2 * | 4/2011 | Coffey | F41B 9/0025 222/79 |
| 8,356,614 | B2 * | 1/2013 | Forrester | A45B 3/14 135/66 |
| 8,474,491 | B2 * | 7/2013 | Lachman | B60S 5/046 141/105 |
| 9,295,320 | B1 * | 3/2016 | McManus | A45F 5/021 |

* cited by examiner

ADJUSTABLE LIQUID CONTAINER HOLDER

CROSS-REFERENCE TO RELATED APPLICATIONS

The present application is a nonprovisional application which claims the benefit of U.S. Provisional Patent Application No. 62/217,377, filed on Sep. 11, 2015, entitled "Adjustable Liquid Container Holder," which is incorporated herein by reference in their entirety as if fully set forth herein.

FIELD OF DISCLOSURE

This disclosure relates generally to the field of methods and systems for holding liquid containers in a portable and mountable fashion

BACKGROUND

The container for liquids was likely among the earliest of human inventions. Early humans used hollowed gourds and animal horns as convenient and accessible water storage. A great deal has changed since the Paleolithic, but the basic human need for accessible liquids has not.

Modern liquid containers are made from many different materials, including plastic, glass, and metal, and are available in nearly any capacity. Some modern liquid containers include flexible suction tubes that permit the user to remove the contents of the container by suction rather than by inverting the container. When not in use, the suction tube be may droop unsupported unless the user tethers the end, generally by means of a clip or other nonpermanent attachment. Some modern liquid containers have loops, straps, or other attachments that permit them to be hung or temporarily mounted. Generally, attachments such as hoses are built specifically to the container, and are usually purchased together as a unit.

In some circumstances, a person may want the ability to use a different liquid container with a suction tube. In some circumstances, a person may want the ability to use a different liquid container and temporarily hang or mount it. Thus, there is a market for a system that permits a user attach non-specific liquid container to a nonpermanent mount and use a suction hose to retrieve the liquid.

SUMMARY

The present disclosure generally describes an adjustable liquid container holder that may be configured to hold liquid containers in a portable and mountable fashion which includes a flexible and extendable tube for removal of container contents.

The foregoing summary is illustrative only and is not intended to be in any way limiting.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure. Also, the drawings included herein are considered by the applicant to be informal.

Figure 1B:
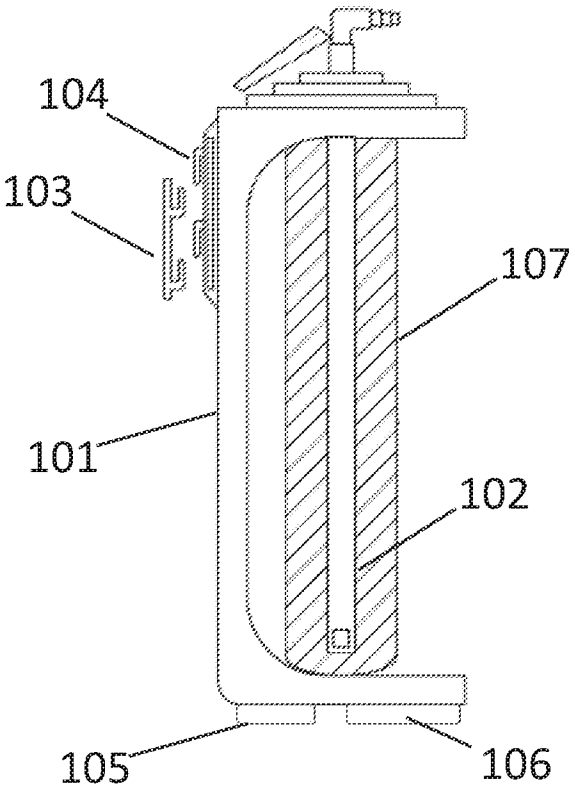
FIG. 1B is a diagram illustrating a side-view of an embodiment of an adjustable liquid container holder with a liquid container.

All arranged in accordance with at least some embodiments of the present disclosure.

DETAILED DESCRIPTION

In the Summary above and in the following detailed description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

The present disclosure is generally drawn, inter alia, to an adjustable liquid container holder. In some examples, the container holder is preferably made of bisphenol A free (BPA free) elastomeric material. However, the container holder may be made out of other flexible materials such as metal, natural or synthetic wood, or rubber materials. In some embodiments, the container holder may be configured generally for approximately cylindrical liquid containers of varying diameters, heights and sizes found in the art. The container holder may be configured with one or more slides or slats and a bungee cord that applies vertical force, downward and upward, respectively, to the top and bottom of a container in such a fashion as to clamp down on the container and fit snugly regardless of the size/height of container. The bungee cord may be substituted by another clamping means such as a spring, hydraulic coupler, pneumatic coupler, electrical motor and switch, or other mechanical leverage device common in the art in order to apply vertical clamping force on the body of the container holder. In some embodiments, the container holder may be configured with a clamping system involving one or more of these clamping means to lock the container holder in place.

In some embodiments, the backbone of the container holder may be configured to mount onto some structure, such as a wall or furniture. The container may be configured to be mountable by screws, hooks, tabs, or velcro straps. A container holder mounted in such a fashion may open up desk space and allow for a place to keep a liquid container where there may not be a good surface to keep a liquid container or a liquid spill may be undesired. Such places may include a hallway nurse's workstation, a computer lab, and a hospital patient's bedside. In some embodiments, the container holder may be mounted for portability by attaching to a belt or luggage, such as while hiking or traveling.

The container frame may be configured with a monolithic or single-piece design, preferably made from a mold or 3D printed, with a single support along the vertical portion of the frame. The single support may be configured with a clamping mechanism running parallel and fore or aft of the vertical support. Alternative embodiments comprise a fastened, multi-piece body and are structurally similar however at the additional cost and weight of fasteners. An embodiment of the frame is the two (dual) supports along the mostly vertical portion of the frame. The two supports are spaced apart to allow a bungee or alternative clamping mechanisms) to fit in between while also reducing material and weight. The base is preferably horizontal and may sit on a relatively flat surface as needed. The profile of the base may be circular to eliminate extra material and waste as opposed to a square or rectangular base. Alternative embodiments for the base include triangular elongations toward the back of the base to provide a tilted stance as well as added wall support for when the container holder is mounted. Additionally, the bottom of the frame may be configured to receive at least two mechanisms on the far bottom side of its base, a retractable reel and a light. The attachment to the base is preferably non-permanent and is done so using screws. Alternative embodiments may use other non-permanent fastening means common in the art such as bolts, pins, friction fit, slots and the like. Still other embodiments may contain permanently fastened retractable reels and lights.

In some embodiments, the lid or the top part of the container holder that clamps down on top of the liquid container may be configured to be adjustable to different sizes or circumference of liquid container mouths. In some embodiments, the lid may be configured with multiple concentric circles that clamp down on top of the bottle and create a seal regardless of the diameter of the liquid container. In some embodiments, the lid may be built in or fit into the top of the container holder frame. In some embodiments, the lid may be made of non-slip material or coated with non-slip material. In some embodiments, the lid may be configured with a one-way valve for air to fill the void left by liquid going out. In some embodiments, the lid may be configured with a carburetor filter around a straw or through a carburetor hole or one-way valve such that when the liquid flows out of the container, the air that flows into the container may be filtered.

In some embodiments, the container holder may be configured to include a telescopic or standard straw. In some embodiments, the straw may be configured to fit through a hole in the lid or top part of the container holder. In some embodiments, the straw may be configured to slide through the hole in the lid to adjust for the liquid container height. In some embodiments, the straw may be configured with holes on the sides near the bottom to prevent a vacuum. In some embodiments, the straw may be configured with an angled top, preferably ninety-degree angle or elbow at the top and comprise a barb, preferably three-eighths of an inch, at the very top end to connect to a flexible hose. In some embodiments, the straw may be configured with a double wall comprising a freezable gel. In some embodiments, the straw may be configured with a detachable freezable/microwavable gel pack of various sizes and shapes wrapping around the straw such that the number of gel packs used may adjust for the height and size of the liquid container.

In some embodiments, the container holder may be configured with a flexible hose connecting the straw to a spigot. In some embodiments, the spigot may be configured for ease of use by comprising indentations for finger gripping, such as for the index and middle fingers. The shape of the spigot is generally smooth and without sharp edges which might cut or injure a user. In some embodiments, the spigot may be configured with a barb, preferable three-eighth of an inch, to connect to a hose. In some embodiments, the spigot may be configured with a bar attached to a retractable cord. In some embodiments, the spigot may be configured to glow in the dark such that a user may easily find the spigot in the dark. In some embodiments, the flexible hose may be a suction hose or a siphon hose. In some embodiments, the flexible hose may be retractable. In a preferred embodiment, the hose may be configured to be mounted above the spigot opening. The spigot configured to fit in the palm of a user's hand with specific sections grooved ergonomically to fit at least the index and middle fingers of a user. The spigot may be used by a left or right hand. A main feature of the spigot is its ergonomic mouthpiece, simple funnel-like shape tapers down into a cylindrical shape which then is used by the user to place into or near their mouth. One embodiment of the spigot allows the user to place the mouthpieces end of the spigot in the mouth while engaging and disengaging the water flow with either index or middle finger. The water flow is stopped or started by a simple valve which enters into the water tube and blocks the flow of water from a container which is being held by the device. An embodiment of the spigot has a detachable retractable string or cord which is attached to the mounted or unmounted container device. The retractable string or cord allows the user to simply release the spigot from their hand and allow the spigot to be retracted toward and eventually in close proximity to the device.

In some embodiments, the bottom and sides/backbone of the container holder may be configured to be non-slip. The bottom may be made of non-slip material or coated with non-slip material. The non-slip material can comprise any combination of rubber, grit, textures, adhesives, water-activated resins, and physical bumps/indents in the container surface or physical locks, pins, clasps or edges which prevent movement. In some embodiments, the bottom, sides or top are configured with an attached retractable cord reel. Where in those embodiments, the end of the cord is attached to the spigot, such that the cord may stretch and retract as needed when a user stretches and retracts the spigot attached to the cord. In some embodiments, the retractable reel may be configured to attach to the top of the container holder, the bottom of the container holder, or to a mount that may be configured to attach to something using a sticking surface, screws, or Velcro. In some embodiments, the container holder may be configured with a battery powered light, reflective material or surface and solar panels for recharging batteries. The battery powered light may be located in proximity to the top of the container holder so that the volume of space for loading the container can be seen. The light is preferably small in size and positioned along the spine/middle of the device to avoid any potential interference with varying sizes of bottles. The reflective material or surface can be made of tapes, textiles, laminated holographic, and those common in the art used for traffic visibility or bicycle reflector materials. The reflective nature of the material is used for when the container holder is used outside of the home and is being transported, which will aid in the safety of the user. In some embodiments, solar panels common in the art will be positioned along the top, sides and bottom of the container holder to store energy to power an integrated light or other electronic needs the user may have.

In other embodiments, the container holder is adapted to be connected to a water source and filter such that the liquid container may be refilled by the container holder. The container holder has simple sensors at the lid or flexible top to be able to sense when the container is full of liquid to signal to stop the flow of liquid into the container.

Figure 1A:
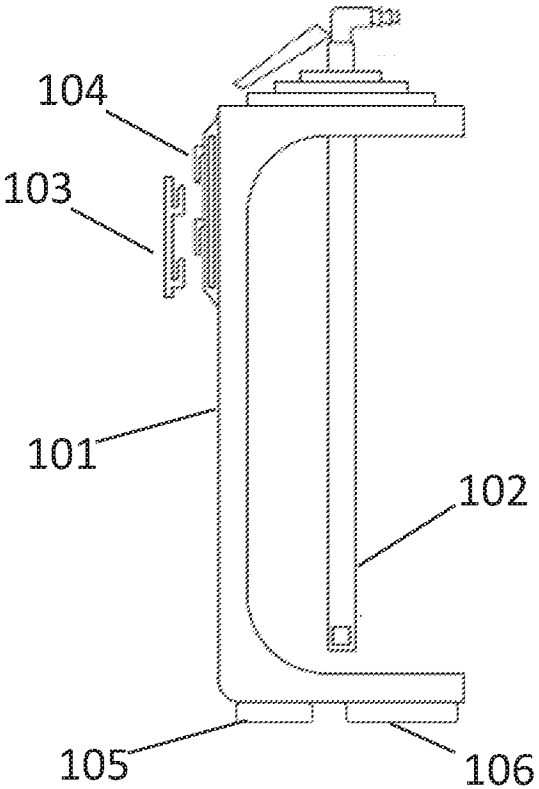
FIG. 1A is a diagram illustrating a side-view of an embodiment of an adjustable liquid container holder.

FIG. 1A is a diagram illustrating a side-view of an embodiment of an adjustable liquid container holder. FIG. 1A includes a frame 101, a straw 102, a mount 103, a mount 104, a light 105, and a reel 106.

In FIG. 1A, frame 101 is a frame with a monolithic design. Straw 102 is a straw attached to the upper portion or lid of frame 101. Straw 102 has holes on the sides towards the bottom to prevent a vacuum when liquid is being removed. The top of straw 102 is angled with a barbed end to connect a flexible hose or tubing. Mount 103 is amounting tab attached to the desired mounting surface, comprising a wall, side of a desk, bedframe, and any other desired location. Mount 104 is a mounting tab attached to frame 101 of the adjustable liquid container holder. Light 105 is a light connected to the bottom of frame 101 in way to light up the liquid container and its contents. Reel 106 is a retractable reel connected to the bottom of frame 101 that may be configured to house a cord attached to a spigot that a user would use to remove liquid. Reel 106 may automatically retract to keep the spigot in a compact position close to the adjustable liquid container holder when not in active use. Light 105 and reel 106 may be separate components or be combined.

FIG. 1B is a diagram illustrating a side-view of an embodiment of an adjustable liquid container holder with a liquid container. FIG. 1B includes a frame 101, a straw 102, a wall mount 103, a mount 104, a light 105, a reel 106, and a liquid container 107. FIG. 1B is the same as FIG. 1A except with liquid container 107 in the adjustable liquid container holder to show placement of liquid container 107 within frame 101.

Figure 2B:
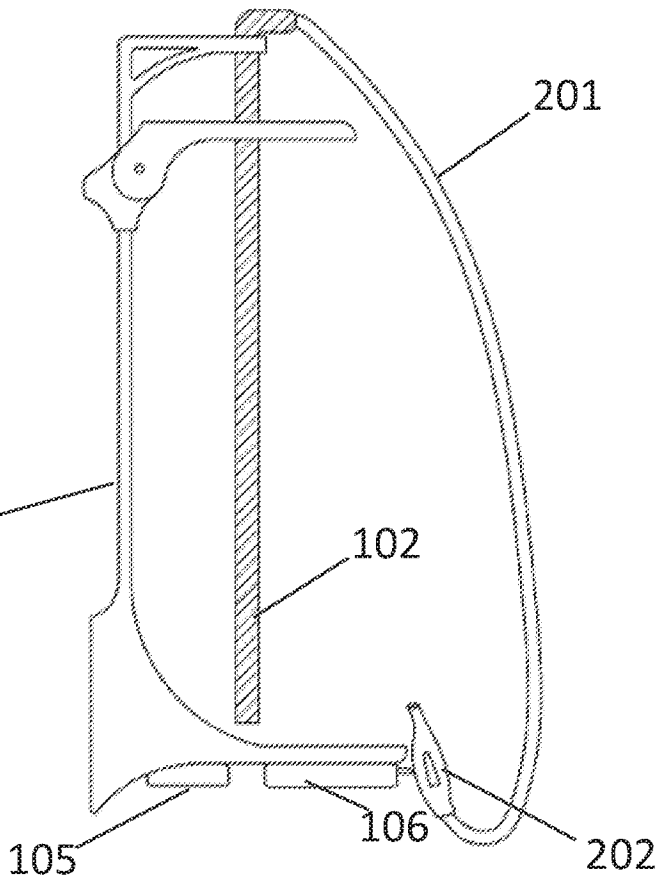
FIG. 2B is a diagram illustrating a side-view of an embodiment of an adjustable liquid container holder.
Figure 2A:
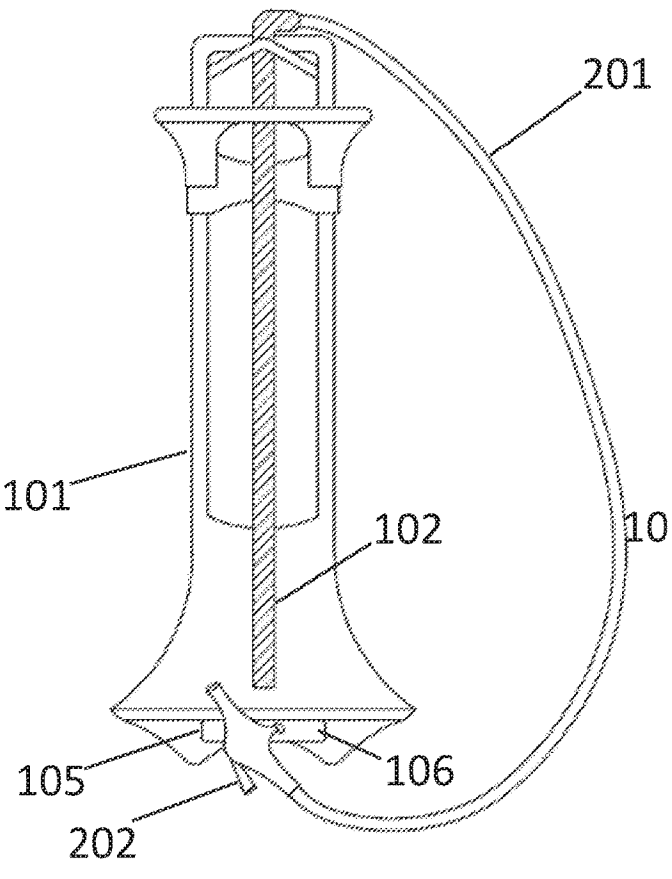
FIG. 2A is a diagram illustrating a front-view of an embodiment of adjustable liquid container holder.

FIG. 2A is a diagram illustrating a front-view of an embodiment of an adjustable liquid container holder. FIG. 2A includes a frame 101, a straw 102, a light 105, a reel 106, a hose 201, and a spigot 202.

In FIG. 2A, frame 101 is a frame with a multi-piece design where dual shafts allow a movable upper frame to fit snugly against a liquid container. In this embodiment, the upper piece of frame 101 slides to apply vertical pressure against a liquid container while allowing straw 102 to stay in place. Straw 102 is secured by the upper part of frame 101 and connected to hose 201, which is connected to spigot 202. Spigot 202 rests near the lower part of frame 101 where light 105 and reel 106 are attached when the cord attached to spigot 202 is retracted in reel 106.

FIG. 2B is a diagram illustrating a side-view of an embodiment of an adjustable liquid container holder. FIG. 2B includes a frame 101, a straw 102, a light 105, a reel 106, a hose 201, and a spigot 202. FIG. 2B is the same as FIG. 2A except that it is a side-view of FIG. 2A.

Figure 3B:
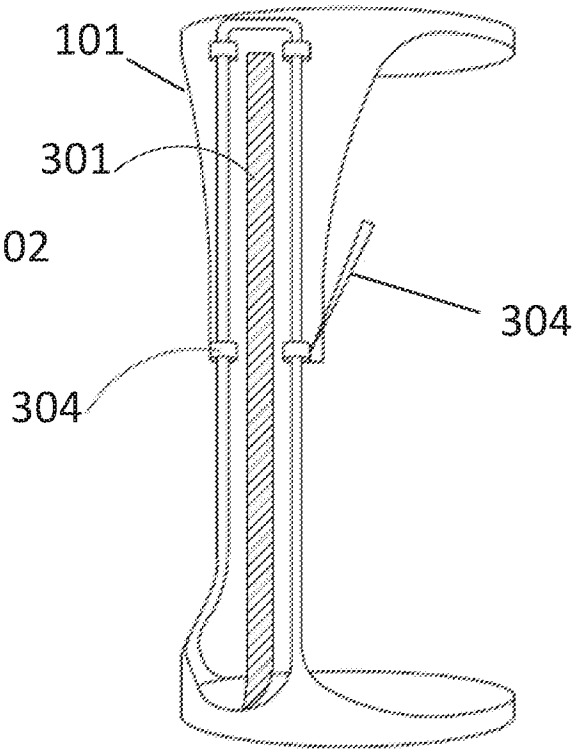
FIG. 3B is a diagram illustrating a rear and side-view of an embodiment of an adjustable liquid container holder.
Figure 3A:
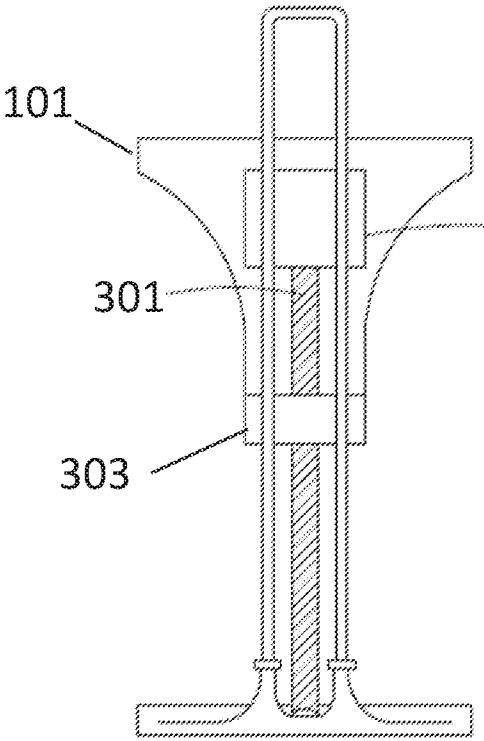
FIG. 3A is a diagram illustrating a rear-view of an embodiment of an adjustable liquid container holder.

FIG. 3A is a diagram illustrating a rear-view of an embodiment of an adjustable liquid container holder. FIG. 3A includes a frame 101, a bungee 301, a mount 302, and a guide 303.

In FIG. 3A, frame 101 is a frame with a multi-piece design where dual shafts allow a movable upper frame to fit snugly against a liquid container. In this embodiment, the upper piece of frame 101 slides to apply vertical pressure against a liquid container by bungee 301. Guide 303 allows the pieces of frame 101 to slide securely and smoothly. Mount 302 allows the adjustable liquid container holder to be temporarily mounted on a desired location.

FIG. 3B is a diagram illustrating a rear and side-view of an embodiment of an adjustable liquid container holder. FIG. 3B includes a frame 101, a bungee 301, and a clamping system 304.

In FIG. 3B, frame 101 is a frame with a multi-piece design where dual shafts allow a movable upper frame to fit snugly against a liquid container. In this embodiment, the upper piece of frame 101 slides to apply vertical pressure against a liquid container by bungee 301. Clamping system 304 further secures the vertical positioning of frame 101.

Figure 4:
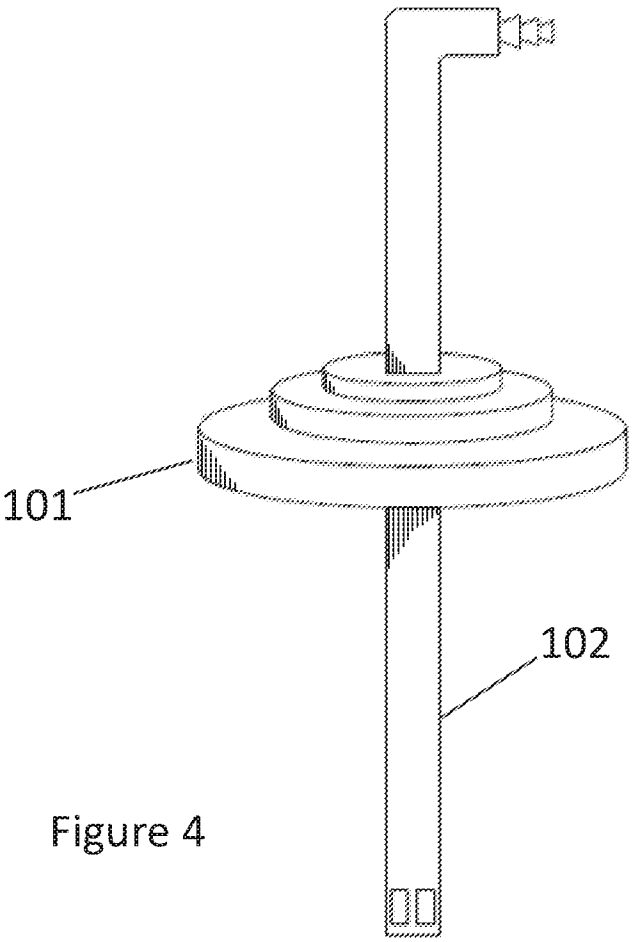
FIG. 4 is a diagram illustrating an embodiment of a lid and a straw.

FIG. 4 is a diagram illustrating an embodiment of a lid and a straw. FIG. 4 includes a frame 101 and a straw 102. In FIG. 4, straw 102 is a straw attached to the upper portion or lid of frame 101. Straw 102 has holes on the sides towards the bottom to prevent a vacuum when liquid is being removed. The top of straw 102 is angled with a barbed end to connect a flexible hose or tubing.

Figures 5A, 5B, 5C:
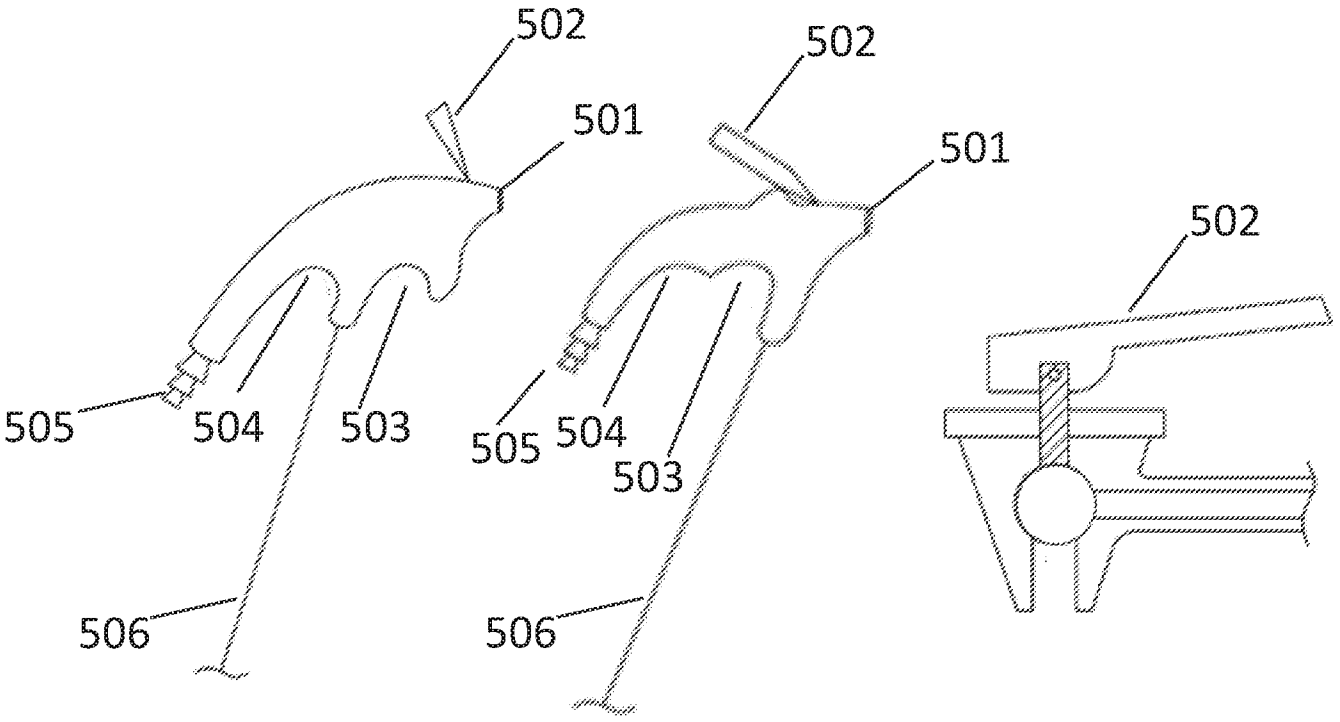
FIG. 5A is a diagram illustrating an embodiment of a spigot.
FIG. 5B is a diagram illustrating an embodiment of a spigot.
FIG. 5C is a diagram illustrating an embodiment of a spigot.

FIG. 5A is a diagram illustrating an embodiment of a spigot. FIG. 5A includes a mouth piece 501, a valve 502, an indentation 503, an indentation 504, a barb 505, and a cord 506. In FIG. 5A, mouth piece 501 is the portion of the spigot a user would bring to the mouth. With either left or right hand, the user would grab the spigot by placing the index finger on indentation 503, the middle finger on indentation 504, and thumb on valve 502. The user would depress valve 502 to release liquid. Barb 505 is where the spigot is attached to a hose connecting to a straw from which to draw liquid in the liquid container. Cord 506 attached to the spigot may be retracted into a reel so that the spigot stays compact near the adjustable liquid container holder out of the user's way but is at the ready to be engaged.

FIG. 5B is a diagram illustrating an embodiment of a spigot. FIG. 5B includes a mouth piece 501, a valve 502, an indentation 503, an indentation 504, a barb 505, and a cord 506. FIG. 5B is a variation of FIG. 5A with a different ergonomic design where indentation 503 and indentation 504 for the index and middle fingers, respectively, are place next to each other rather than sandwiching the cord.

FIG. 5C is a diagram illustrating an embodiment of a spigot. FIG. 5C includes a valve 502. FIG. 5C is another variation of FIG. 5A.

Figure 6:
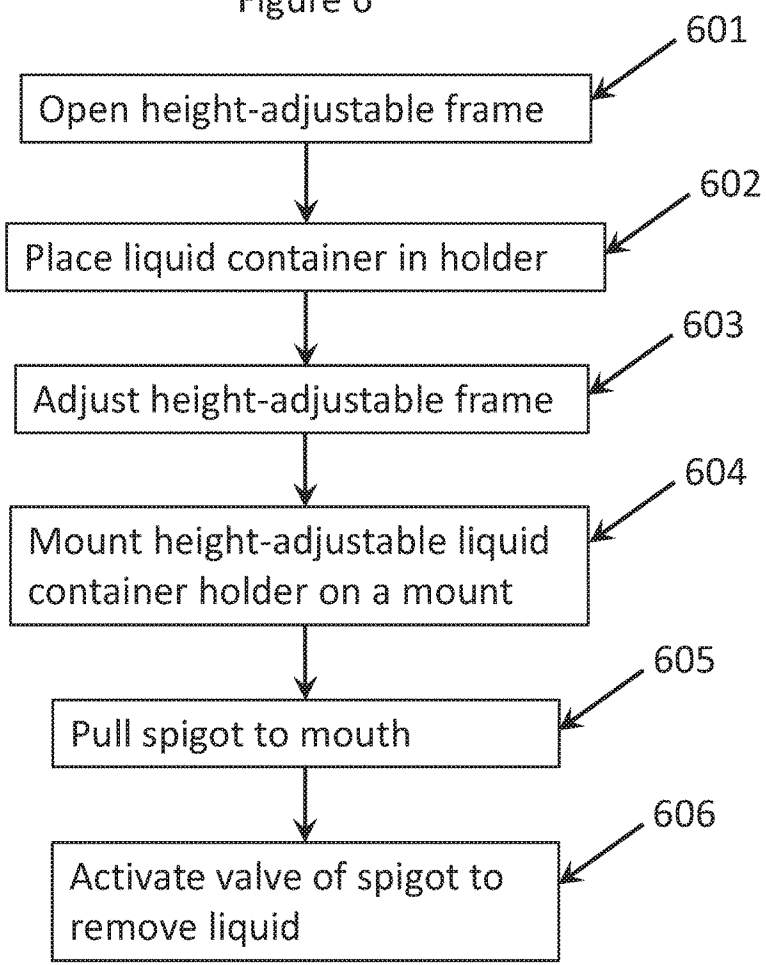
FIG. 6 is a flow diagram of the method to hold liquid containers in a portable and mountable fashion while still being able to retrieve liquid.

FIG. 6 is a flow diagram of the method to hold liquid containers in a portable and mountable fashion while still being able to retrieve liquid. FIG. 6 includes a step 601, a step 602, a step 603, a step 604, a step 605, and a step 606.

In FIG. 6, a flow diagram outlining the method steps to hold liquid containers portable and mountable fashion while still being able to retrieve liquid is shown. In step 601, a user of a height-adjustable liquid container holder opens the height-adjustable frame to a height longer than that of a liquid container to be installed. Opening the frame may require unclamping a clamping system before spreading the frame. In step 602, the liquid container is inserted into the height-adjustable liquid container holder. In step 603, the height-adjustable frame is adjusted to fit snugly against the liquid container holder. In some embodiments, there may be a clamping system that may be engaged to further secure the frame. In step 604, the height-adjustable liquid container holder is mounted in a desired location on a mount. In step 605, a user, when liquid is desired, may grab the spigot and pull the spigot to the user's mouth. In step 606, the user may activate the valve of the spigot to remove liquid. While preferred and alternate embodiments have been illustrated and described, as noted above, many changes can be made without departing from the spirit and scope of the Adjustable Liquid Container Holder. Accordingly, the scope of the Adjustable Liquid Container Holder is not limited by the disclosure of these preferred and alternate embodiments. Instead, the scope of the Adjustable Liquid Container Holder should be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

What is claimed is:

1. A liquid container holder comprised of:
a height-adjustable frame;
an adjustable lid, wherein said adjustable lid accommodates different diameters of liquid containers;
a base;
a flexible tube;
a spigot with a retractable cord and reel; and
a mount.

2. The liquid container holder of claim 1, wherein the height-adjustable frame, and base are made of at least one of the following flexible materials: metal, natural wood, synthetic wood, rubber, and plastic, biphenol A (BPA) free.

3. The liquid container holder of claim 1, wherein the height-adjustable frame, base, and lid are made of or coated with non-slip material comprising any one or combination of rubber, grit, textures, adhesives, water-activated resins, and physical bumps/indents.

4. The liquid container holder of claim 1, wherein the height-adjustable frame is comprised of or be coated with reflective material.

5. The liquid container holder of claim 1, wherein the height-adjustable frame further comprises solar panels.

6. The liquid container holder of claim 1, wherein the height-adjustable frame is comprised of two parts: an upper frame and a lower frame.

7. The liquid container holder of claim 6, wherein the upper and lower frames of the height-adjustable frame may prevent movement of the liquid container with any one or combination of physical locks, pins, clasps, or edged border.

8. The liquid container holder of claim 6, wherein the upper and lower frames of the height-adjustable frame are held together by vertical forces or alternative clamping mechanisms.

9. The liquid container holder of claim 1, wherein a light along the height-adjustable frame or base illuminates the liquid container.

10. The liquid container holder of claim 1, wherein a light is affixed to the retractable cord and reel.

11. The liquid container holder of claim 1, wherein the flexible tube further comprises holes on sides near a bottom to avoid creating a vacuum.

12. The liquid container holder of claim 1, wherein the flexible tube is a suction hose or a siphon hose.

13. The liquid container holder of claim 1, wherein the spigot is capable of glowing.

14. The liquid container holder of claim 1, wherein the spigot has ergonomical indentations for finger gripping.

15. The liquid container holder of claim 1, wherein the mount for temporary storage comprises mounting tabs, hooks, screws, or slots for Velcro or straps.

16. A method of storing a liquid container using the liquid container holder of claim 1, wherein said method comprising:
opening said height-frame of the liquid container holder;
placing a liquid container in the liquid container holder while inserting a flexible tube in the liquid container, wherein said liquid container contains a liquid;
adjusting said height-adjustable frame to secure the liquid container in place;
mounting the height-adjustable liquid container holder on the mount; and
activating a valve located on said spigot to remove said liquid.

17. The method of storing a liquid container of claim 16 further comprising: said liquid container holder with one or more non-permanent attachments at a bottom and a top of the liquid container holder to secure the liquid container holder in place.

18. The method of storing a liquid container of claim 16 further comprising: releasing of the spigot and allowing a retractable attachment to return the spigot to the liquid container holder.

* * * * *